US006808423B2

(12) United States Patent
Lin et al.

(10) Patent No.: US 6,808,423 B2
(45) Date of Patent: Oct. 26, 2004

(54) CONNECTION-CONVERTING DEVICE FOR AN EXPANSION CARD IN A PORTABLE ELECTRONIC PRODUCT

(75) Inventors: Yao-Chung Lin, Shindian (TW); Rung-Lung Wu, Shindian (TW); Wan-Hsieh Liu, Taipei (TW)

(73) Assignee: High Tech Computer Corp., Taoyuan (TW)

( * ) Notice: Subject to any disclaimer, the term of this patent is extended or adjusted under 35 U.S.C. 154(b) by 0 days.

(21) Appl. No.: 10/355,080

(22) Filed: Jan. 31, 2003

(65) Prior Publication Data

US 2003/0148639 A1 Aug. 7, 2003

(30) Foreign Application Priority Data

Feb. 6, 2002 (TW) ..... 91102135 A

(51) Int. Cl.[7] ..... H01R 24/00
(52) U.S. Cl. ..... 439/630; 439/638; 439/945
(58) Field of Search ..... 439/630, 638, 439/945, 607–610, 631; 361/735, 737

(56) References Cited

U.S. PATENT DOCUMENTS 6,089,915 A * 7/2000 Ho et al. ..... 439/607
6,264,506 B1 * 7/2001 Yasufuku et al. ..... 439/638
6,413,109 B1 * 7/2002 Kobayashi et al. ..... 439/362
6,457,647 B1 * 10/2002 Kurihashi et al. ..... 439/945

* cited by examiner

*Primary Examiner*—Tho D. Ta
(74) *Attorney, Agent, or Firm*—Rabin & Berdo, P.C.

(57) ABSTRACT

A connection-converting device (300) is used to connect an expansion card (110) to a portable electronic product (20), for example, a personal digital assistant which has a circuit board (100) and a card socket (120) mounted on the board. The expansion card is implemented with an M number of signal terminals (415), and the card socket is implemented with an N number of pins (150), wherein, the number of signal terminals is greater than the number of pins. The board is provided a P number of contact pads (250) thereon, wherein P is equal to M minus N. The connection-converting device (300) has an M number of signal pins (315) electrically engaging with the signal terminals (415), an N number of receptacle terminals (335) electrically connecting with the pins (150) and a P number of external contact terminals (350) electrically connecting with the contact pads (250).

11 Claims, 4 Drawing Sheets

CONNECTION-CONVERTING DEVICE FOR AN EXPANSION CARD IN A PORTABLE ELECTRONIC PRODUCT

This application claims the benefit of Taiwan application Serial No. 091102135, filed Feb. 6, 2002.

BACKGROUND OF THE INVENTION

1. Field of the Invention

This invention relates to a connection-converting device, and more particularly, to a connection-converting device for an expansion card in a portable electronic product.

2. Description of Related Art

In recent years, the 3C industry, which includes industries of computer, communication, and consumer appliance, has played an essential role in the portable electronic products. As the 3C industry rapidly develops, the products, such as the various kinds of notebook computers, cellular phones, personal digital assistants, and so on, will be in greater demand in the future. Additionally, the developing trend is toward lighter, smaller and more compact products. Furthermore, the technology is upgraded day by day. As a result, these kinds of portable electronic products can be integrated together and further can be combined with the information appliance (IA), so that they can provide a variety of functions to meet the user's increasing demands. For portable electronic products, an important design issue is the efficient use of the limited spaces. Under the current trend, the recent portable electric products, such as the personal digital assistant or the electronic dictionary, have been designed to occupy less volume and offer versatile functions. Thus, the design associated with the plug-in card is crucial and has received much attention. Taking the personal digital assistant as an example, the designer usually will design a plug-in card socket, such as a plug-in card socket for a compact flash (CF) card, so as to allow the user to freely change the memory cards and achieve the purpose of expanding the memory capacity. The compact flash card has been widely used in the personal digital assistant or the digital camera and its hardware specification is now very popular. Thus, many portable electronic products have the support. However, the card socket of the compact flash card can accept only a limited number of pins (50 pins for the specification of the compact flash card). Therefore, it is impossible for use with an expansion card with more signal terminals, such as the Personal Computer Memory Card International Association (PCMCIA) card having 68 pins. Referring to FIG. 1, it is a drawing, schematically illustrating the relation between a card socket 120 and an expansion card 110 in accordance with the conventional art. The card socket 120 is soldered on a circuit board 100 of the portable electronic product. The card socket 120 has a number of pins 150 which are used for electrically connecting with the card 110 when the card 110 is inserted into the connector 120. If the number of terminals of the card 110 is not greater than the number of the pins 150, then the expansion card 110 can be plugged into the card socket 120. However, if the number of terminals of the expansion card 110 is greater than the number of the pins 150 (such as 68 terminals for the PCMCIA card versus 50 pins for the compact flash card socket), then the expansion card 110 cannot be directly plugged into the card socket 120. If the portable electronic product is implemented with several different card sockets having different numbers of pins for receiving different cards, then the volume of the product will increase, and this is contrary to the design trend of smaller and more compact products.

SUMMARY OF THE INVENTION

It is therefore an objective of the present invention to provide a connection-converting device for an expansion card. As a result, the expansion card with a larger number of signal terminals can be plugged into the card socket having fewer pins. This can allow the portable electronic product to electrically connect different expansion cards having different sizes and terminal numbers, without the necessity to equip the product with different card sockets.

In accordance with the foregoing and other objectives of the present invention, the invention provides a connection-converting device for an expansion card. The connection-converting device is described in the following.

The connection-converting device is used to connect the expansion card to a portable electronic product including a card socket, wherein the expansion card is implemented with an M number of signal terminals, and the card socket is implemented with an N number of pins. The M number is larger than the N number and a P number is equal to the M number minus the N number. A circuit board to which the card socket is soldered is provided with a P number of contact pads thereon. The connection-converting device includes a retrieve packing part and a plug-in terminal below the retrieve packing part. When the expansion card is plugged to the connection-converting device, the expansion card is secured thereto by the retrieve packing part. An M number of plug-in pins are provided in the retrieve packing part, which electrically connect with the signal terminals of the expansion card. Thereafter, the plug-in terminal of the connection-converting device is plugged to the card socket. Since the plug-in terminal is implemented with an N number of receptacle terminals, when the plug-in terminal is plugged into the card socket, each receptacle terminal electrically engages with a corresponding pin of the card socket. In addition, a P number (which is equal the M number minus the N number) of external contact terminals is implemented at the bottom portion of the connection-converting device; when the plug-in terminal is inserted into the card socket, the external contact terminals electrically engage with the contact pads on the circuit board, respectively. Thus, the expansion card is electrically connected with the portable electronic product. The receptacle terminals and the external contact terminals are respectively electrically connected with the plug-in pins of the connection-converting device.

BRIEF DESCRIPTION OF DRAWINGS

The invention can be more fully understood by reading the following detailed description of the preferred embodiment, with reference made to the accompanying drawings, wherein.

DETAILED DESCRIPTION OF PREFERRED EMBODIMENT

Figure 1:
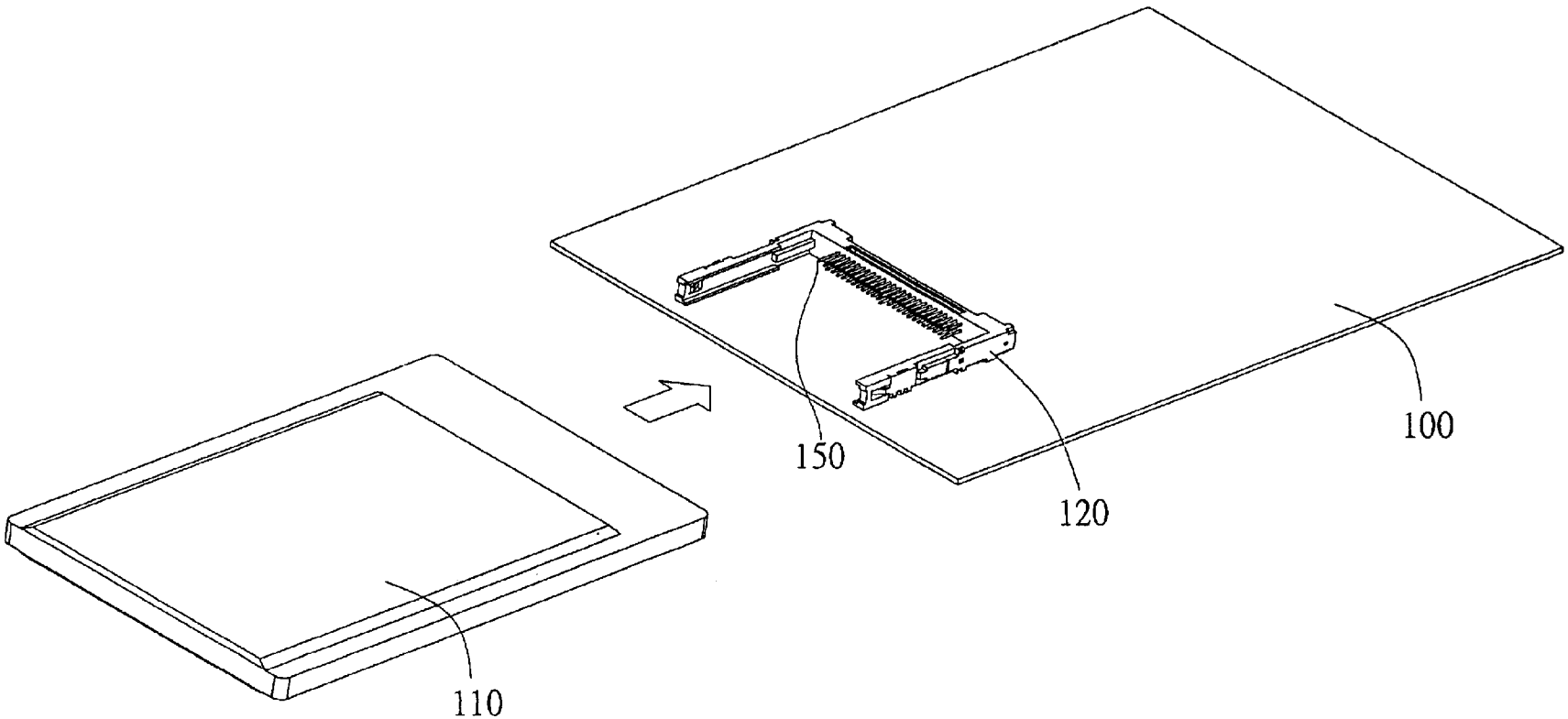
FIG. 1 (PRIOR ART)
FIG. 1 is a drawing, schematically illustrating the relation between the card socket and the expansion card corresponding to the card socket, in accordance with the conventional art.
Figure 2:
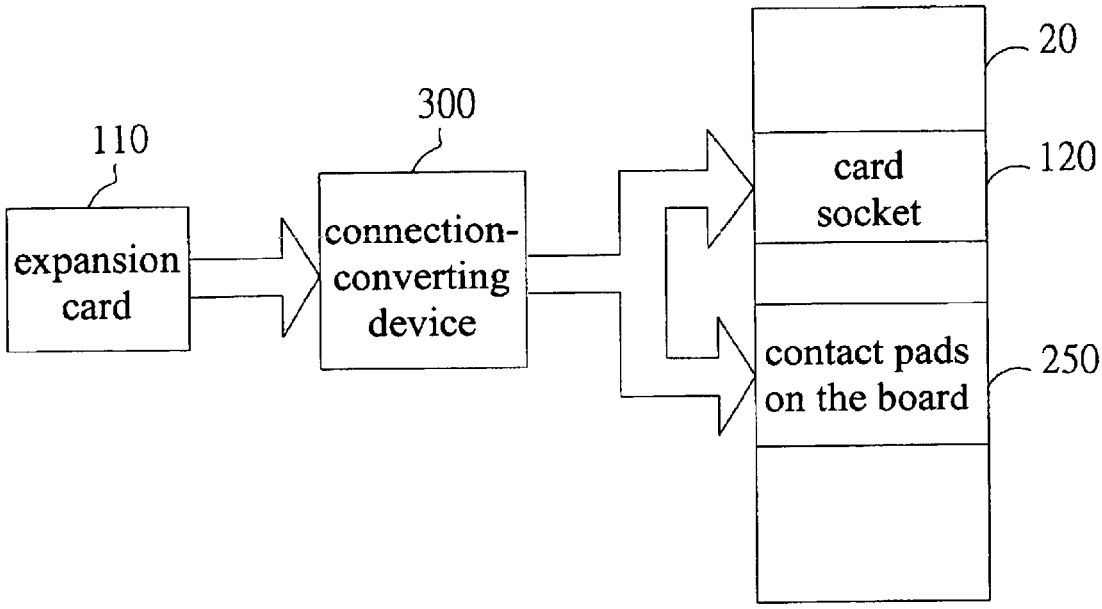
FIG. 2 is a drawing, schematically illustrating the relationship how a connection-converting device in accordance with the present invention connects an expansion card to a portable electronic product.

Please refer to FIG. 2, which is a block diagram, schematically illustrating a connection-converting device 300 for connecting an expansion card 110 to a portable electronic product 20, according to a preferred embodiment provided by the present invention. The expansion card 110 includes an M number of signal terminals and the card socket 120 has an N number of pins, in which M and N are integers, and M is greater than N, and M−N=P. A circuit board on which the card socket 120 is mounted is implemented with a P number of contact pads 250 thereon. In this manner, the summation of the number N pins on the card socket 120 and the number P of contact pads 250 on the board is equal to the number M of signal terminals on the expansion card 110. As a result, all of the signals sent by the expansion card 110 can be received by the portable electronic product 20 via the pins of the card socket 120 and the contact pads 250 of the circuit board. The connection-converting device 300 is provided with an M number of signal pins to be correspondingly coupled to the M number of signal terminals of the expansion card 110. By the design of the connection line layout, N number of signal pins out of the M number of signal pins can be selected for coupling to the pins 150 of the card socket 120. The rest P number of signal pins can be coupled to the contact pads 250 on the board. In this manner, after the expansion card 110 is coupled to the connection-converting device 300, it only needs that the connection-converting device 300 is coupled to the card socket 120 and the contact pads 250 on the board. Then the signals on the expansion card 110 can be fed to the portable electronic product 20 via the pins 150 of the card socket 120 and the contact pads 250 on the board, so that the signal processing operation by the portable electronic product 20 can be performed.

Figure 3:
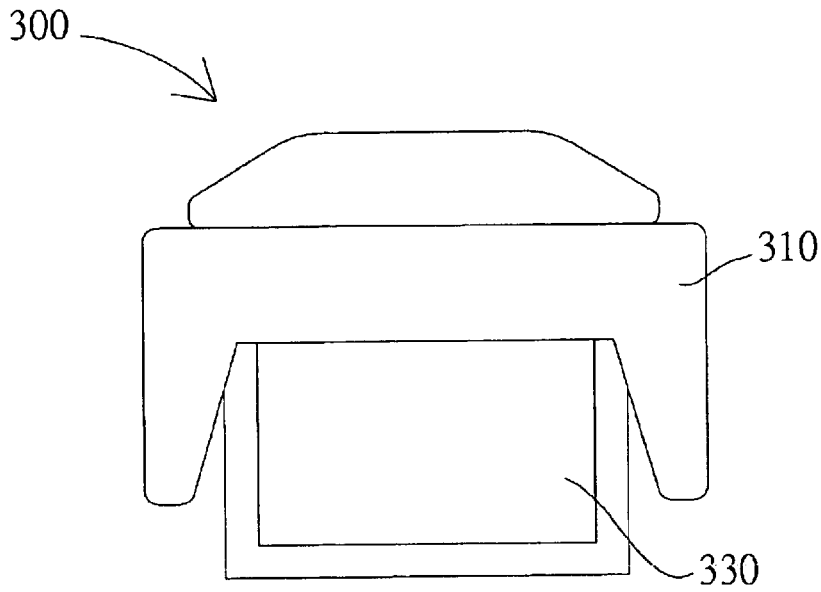
FIGS. 3–5 are respectively top, front and bottom views of a connection-converting device in accordance with the present invention.
Figure 4:
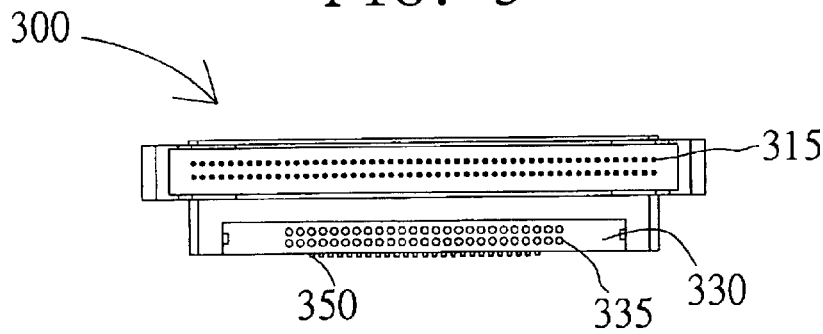
Figure 5:
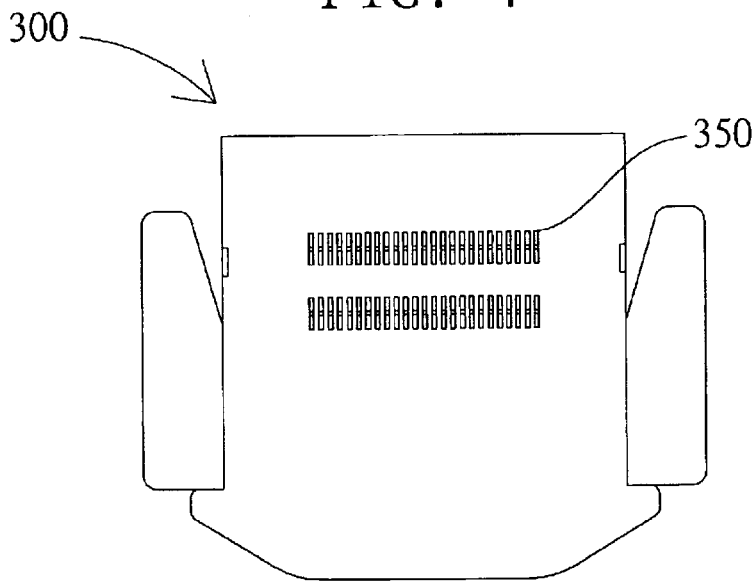

Referring to FIGS. 3–5, the connection-converting device 300 according to the invention includes a retrieve packing part 310 and a plug-in terminal 330. When the expansion card is plugged to the connection-converting device 300, the retrieve packing part 310 functions to secure the expansion card. The connection-converting device 300 has an M number of signal pins 315 in the retrieve packing part 310 electrically engaging the terminals of the expansion card. The plug-in terminal 330 of the connection-converting device 300 is then plugged into the card socket 120. In the practical operation, since the plug-in terminal 330 is implemented with an N number of receptacle terminals 335, when the plug-in terminal 330 is plugged to the card socket 120, each receptacle terminal 335 is coupled to a corresponding pin 150 of the card socket 120, so that the signals can be easily transmitted. Additionally, a P number of external contact terminals 350 are implemented at the bottom portion of the connection-converting device 300, so as to be correspondingly coupled to the contact pads 250 on the circuit board 100.

Figure 6:
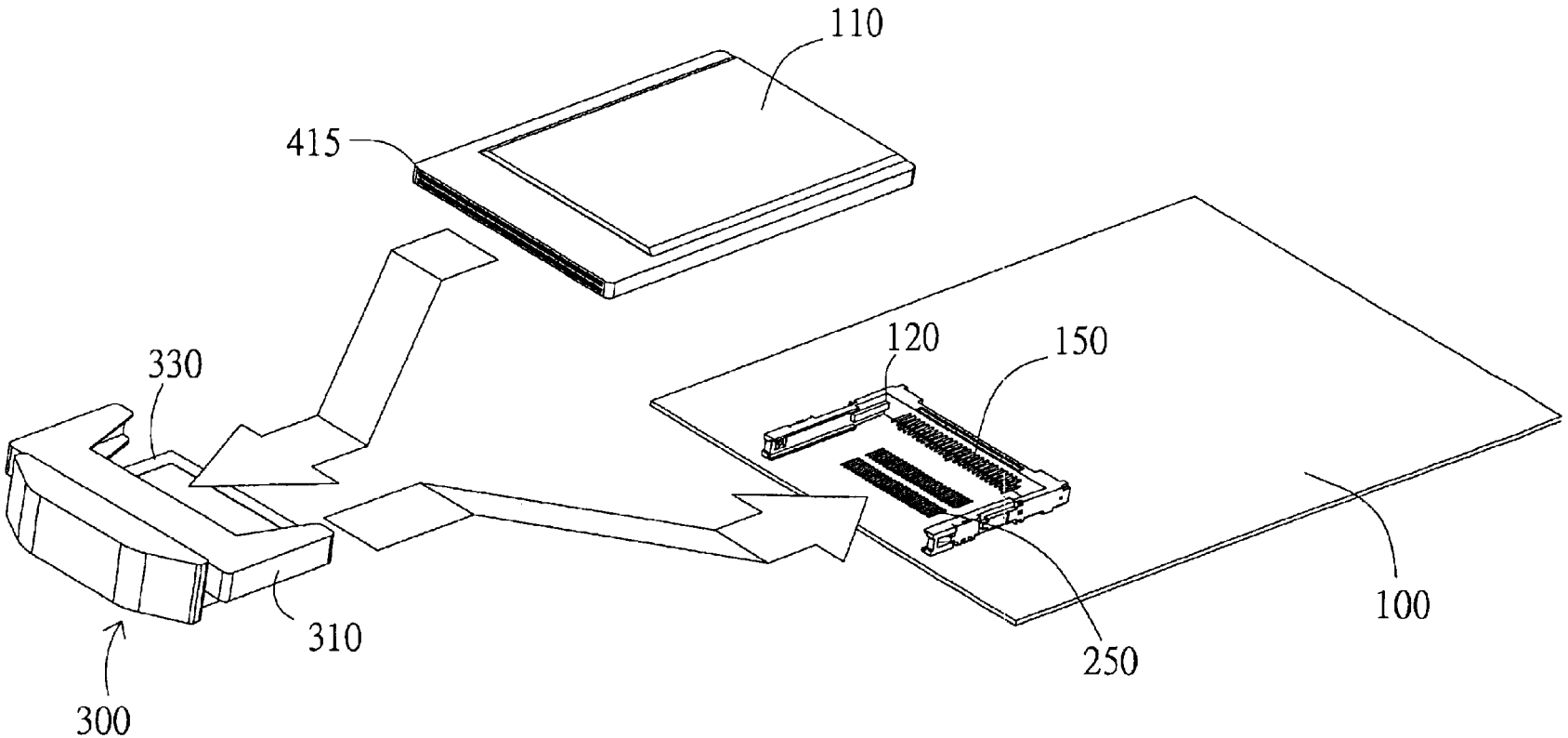
FIG. 6 is a drawing, schematically illustrating a coupling relation between the expansion card, the connection-converting device, a card socket and a circuit board of the portable electronic product.

Referring to FIG. 6, it is a drawing schematically illustrating a coupling relation between the expansion card 110, the connection-converting device 300, the circuit board 100 and the card socket 120, according to the invention. One side of the expansion card 110 is implemented with an M number of signal terminals 415. After expansion card 110 is inserted into the connection-converting device 300, each signal terminal 415 is correspondingly coupled to each signal pin 315. Then, the connection-converting device 300 is coupled to the card socket 120 and each receptacle terminal 335 of the plug-in terminal 330 is correspondingly coupled to each pin 150 of the card socket 120. Each external contact terminal 350 is correspondingly coupled to each contact pad 250 on the board 100.

In summary of the present invention, the foregoing example with the preferred embodiment of the present invention discloses a connection-converting device for an expansion card with at least the following advantages:

1. The present invention allows the portable electronic product to support more versatile expansion cards. This versatility can greatly increase the value of the product.
2. The present invention allows the connection-converting device to be plugged in when it is needed. During the usual operation, it will not occupy extra space.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A connection-converting device for connecting an expansion card with a portable electronic product, the expansion card being implemented with M signal terminals, the portable electronic product including a circuit board, a card socket mounted on the circuit board, the card socket being implemented with N pins, wherein M and N are positive integers and M is greater than N, the connection-converting device for the expansion card comprising:

a retrieve packing portion, used to secure the expansion card when the expansion card is inserted into the connection-converting device;

M signal pins in the retrieve packing portion, used to be coupled with the signal terminals of the expansion card;

a plug-in terminal below the retrieve packing portion having N receptacle terminals in electrical connection with the M signal pins, and used to be connected to the card socket by plugging the plug-in terminal into the card socket; and a number of external contact terminals below the plug-in terminal and in electrical connection with the M signal pins, used to electrically connect with contact points on the circuit board.

2. The connection-converting device for the expansion card as recited in claim 1, wherein the portable electronic product is a personal digital assistant.

3. The connection-converting device for the expansion card as recited in claim 1, wherein the portable electronic product is an electronic dictionary.

4. The connection-converting device for the expansion card as recited in claim 1, wherein the expansion card is a personal computer memory card international association (PCMCIA) card.

5. The connection-converting device for the expansion card as recited in claim 1, wherein N is equal to 50.

6. The connection-converting device for the expansion card as recited in claim 1, wherein M minus N is equal to P, and the number of the external contact terminals is equal to P.

7. An electrically interconnecting system, comprising:

a circuit board having P contact pads thereon;

a card socket mounted on the circuit board, said card socket having N pins;

a connection-converting device having N receptacle terminals electrically engaging with the N pins of the card socket, P external contact terminals electrically engaging with the P contact pads of the circuit board and M signal pins electrically connecting with the N receptacle terminals and the P external contact terminals, respectively, wherein M is equal to P plus N; and an expansion card having M signal terminals electrically engaging with the M signal pins of the connection-converting device.

8. The electrically interconnecting system as recited in claim 7, wherein the P external contact terminals are located below the N receptacle terminals of the connection-converting device, and the N receptacle terminals are located below the M signal pins of the connection-converting device.

9. The electrically interconnecting system as recited in claim 8, wherein the connection-converting device has a means for securing the expansion card on the connection-converting device.

10. A connecting device for electrically connecting an electronic card to an electronic product, the electronic card having a M number of terminals, the connecting device comprising:

a printed circuit board having a number of contact pads thereon;

an electrical connector mounted on the printed circuit board and having a number N of terminals, wherein N is smaller than M; and a connection-converting device adapted for electrically connecting with the electronic card, having a number of first contacts electrically connecting with the N terminals of the electrical connector and a number of second contacts electrically connecting with the contact pads of the printed circuit board, wherein the number of second contacts of the connection-converting device is P and P is equal to M minus N.

11. The connecting device as recited in claim 10, wherein the second contacts are located below the first contacts.

* * * * *